United States Patent [19]

Sharpless

[11] 4,199,675

[45] Apr. 22, 1980

[54] ELECTRIC FLUID HEATER

[75] Inventor: John Sharpless, Oberlin, Ohio

[73] Assignee: Nordson Corporation, Amherst, Ohio

[21] Appl. No.: 809,511

[22] Filed: Jun. 23, 1977

[51] Int. Cl.[2] ..... H05B 1/02; F24H 1/12

[52] U.S. Cl. ..... 219/305; 137/341; 219/302; 219/308; 219/328; 222/146 HE; 239/135

[58] Field of Search ..... 219/296–309, 219/328, 331; 165/156, 154; 239/133–136, 128; 222/146 R, 146 H, 146 HE; 132/341

[56] References Cited

U.S. PATENT DOCUMENTS

| | | | |
|---|---|---|---|
| 1,069,378 | 8/1913 | Bell et al. | 219/302 |
| 2,145,287 | 1/1939 | Beyrodt | 219/302 X |
| 2,841,215 | 7/1958 | Messer | 239/135 |
| 2,995,159 | 8/1961 | Berggren | 222/146 HE |
| 3,176,113 | 3/1965 | Eckerfeld et al. | 219/307 X |
| 3,477,644 | 11/1969 | Bablouzian | 239/135 |
| 3,584,194 | 6/1971 | Kautz et al. | 219/305 |
| 3,835,294 | 9/1974 | Krohn et al. | 219/305 |
| 3,898,428 | 8/1975 | Dye | 219/305 |

FOREIGN PATENT DOCUMENTS

| | | | |
|---|---|---|---|
| 2156029 | 5/1973 | Fed. Rep. of Germany | 219/305 |

*Primary Examiner*—A. Bartis

*Attorney, Agent, or Firm*—George J. Coghill

[57] ABSTRACT

An in-line electric heater for heating fluids, such as paint, moving in a conduit has a thermally conductive massive body in which is formed a fluid passage having an inlet port and a outlet port. An electric heating element in the body directly heats only the upstream portion of the fluid passage and heater body. The downstream portion of the fluid passage and heater body is indirectly heated to a substantially lesser temperature by heat conduction from the upstream portion whereby the downstream portion acts as a "thermal accumulator" which damps the cycling, overshoot and undershoot of the temperature of the fluid at the outlet port of the passage. A temperature control means for controlling operation of the heating element is provided and includes a temperature sensor arranged to sense the temperature of the proximate the point in the passage wherein the fluid exhibits its greatest temperature cycling excursion, undershoot and overshoot under constant flow conditions, thereby providing optimum feedback control.

11 Claims, 1 Drawing Figure

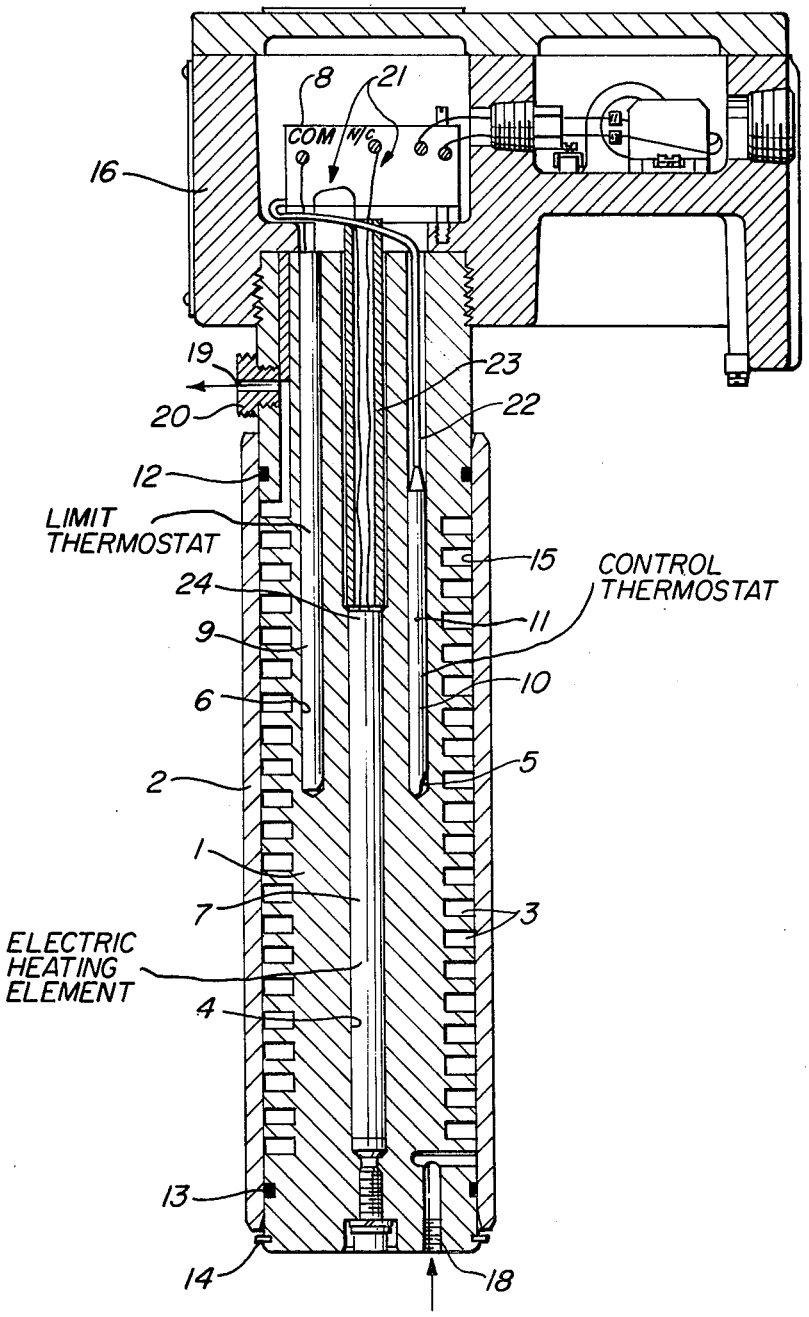
8
21
COM
N/C
16
19
20
23
22
12
LIMIT THERMOSTAT
15
CONTROL THERMOSTAT
24
11
9
10
6
5
2
1
7
3
ELECTRIC HEATING ELEMENT
4
13
14
18

ELECTRIC FLUID HEATER

BACKGROUND OF THE INVENTION

1. Field of the Invention

This invention relates to fluid heaters and more particularly relates to in-line fluid heaters for fluids moving in a conduit where the flow rate of the fluid is subject to variations, or where the temperature of the fluid at the outlet of the heater is subject to cycling variations.

2. Description of the Prior Art

Fluid heaters are used in many applications and for many different types of fluids. For example, there are heaters for water, thermoplastic materials, paints, etc. In the spray coating industry, heating paint or coating materials lowers the viscosity of the paint so that paints having high viscosities, which could not normally be applied with spray coating equipment, can be sprayed. The in-line fluid heater disclosed as the preferred embodiment herein was specifically developed for heating paints. However, the inventive principles used are equally applicable to fluid heaters generally.

In-line fluid heaters of the past generally comprised a fluid passage in heat transfer relationship with a heating element; for example see Krohn et al. U.S. Pat. No. 3,835,294. The heating elements in some heaters were in direct contact with the fluid, and in others the heating element heated the fluid indirectly by heating the structure in which the fluid passage was formed, which structure in turn transferred the heat to the fluid in the passage. In heaters of past design the heating element was positioned with respect to the fluid passage in the heater so as to heat the fluid substantially uniformly for the entire length of the passage.

If the thermal characteristics of the fluid and the flow rate of the fluid to be heated were not subject to variations during operation, some heaters were designed so that the outlet temperature of the fluid achieved the proper value with the heating element having constant power input, and there was no need for any control mechanism. However, if the thermal characteristics of the fluid or its flow rate were subject to variations, then a feedback type control was used to assure that the temperature of the fluid being discharged was within a certain allowable range around a desired value. A temperature sensor monitored the temperature of the fluid being discharged from the outlet of the heater, and a control device responsive to the temperature sensor controlled the heating element.

By use of sophisticated and expensive control devices and heater designs, the temperature range could be held to a very close tolerance over a wide range of flow rates and/or thermal properties. However, in heaters of relatively simple and inexpensive design, certain trade-offs had to be accepted. For example, many heaters used a thermostatic type sensor/control combination to monitor the temperature of the fluid at the outlet of the heater. By "thermostatic type" sensor/control is meant one which turns a heater element on or off in response to some preselected temperature. In heaters using a thermostatic type sensor, the temperature of the fluid at the outlet of the heater, even under constant flow rate and thermal characteristics of the fluid, were prone to steady-state cycling of the outlet temperature between high and low peak-to-peak temperatures. This was due to the on-off cycling of the heating element, on/off differential of the temperature sensor, etc. Also in many heaters of past design, when the heater was initially started, or when the temperature setting was suddenly increased, or when the flow rate of the fluid was suddenly reduced, the temperature of the fluid at the outlet of the heater would overshoot the high steady-state peak cycling temperature. That is, the temperature of the fluid would temporarily exceed the high peak temperature which the fluid would reach under steady-state cycling. Conversely, when the temperature setting was decreased or flow rate of the fluid suddenly increased, the temperature of the fluid at the outlet of the heater would undershoot the low steady-state peak cycling temperature. The temperature of the fluid would fall below the low peak temperature which it would drop to under steady-state cycling.

The cycling of temperature, overshoot and undershoot is caused at least in part by what might be termed thermal lag. This thermal lag is caused by the fact that a finite time is required for a body to change temperature and hence to react to a temperature change. When the heating element is on, the temperature of the fluid is increasing. But when the fluid reaches proper temperature, the sensor requires a finite time to respond to this temperature. Also the heating element requires a finite time to cool down. During this time energy continues to be applied to the fluid. This causes the temperature of the fluid to increase beyond the desired to set temperature. When the heating element has been off and the fluid temperature decreases below the desired temperature, a finite time is required for the sensor to react to this situation and to energize the heating element. The temperature of the fluid continues to decrease before the heating element heats up and causes the temperature of the fluid to increase.

It is an object of the present invention to reduce the steady-state cycling of the feedback controlled fluid heaters as well as their overshoot and undershoot characteristics. Through the present invention these reductions can be achieved in simple inexpensive heaters using thermostatic control, as well as in heaters using more sophisticated control means, and without adding undue cost to the heater.

SUMMARY OF THE INVENTION

The present invention is an improved in-line paint heater having feedback control of the fluid temperature, wherein the heating element operates directly on only the upstream portion of the fluid passage in the heater body. The downstream portion of the fluid passage and heater body is indirectly heated, and therefore heated substantially less than the upstream portion. This downstream portion acts as a "thermal accumulator" which damps the cycling, overshoot and undershoot of temperature. This integral downstream "accumulator" portion of the heater body has a substantial thermal mass (specific heat times mass) and fluid passage surface area. It is insulated sufficiently from the ambient conditions so that it does not merely cool the fluid passing through. Heat is taken up by the "accumulator" portion when it is colder than the fluid, and given off to the fluid from the "accumulator" when it is hotter than the fluid. Thus this accumulator portion of the heater damps cycling, overshoot or undershoot of the temperature of the fluid at the outlet port of the heater. The effect is more pronounced as flow rate increases.

BRIEF DESCRIPTION OF THE DRAWING

The invention can be more fully understood by reference to the drawing FIGURE which depicts a partially cross-sectional view of an in-line fluid heater embodying the present invention.

DESCRIPTION OF THE PREFERRED EMBODIMENT

Generally, the heater comprises a heater body consisting essentially of a heater core 1 and cover 2, a heating element 7, a temperature sensor 10, and a control box 16.

The heater core 1 is an elongated cylindrically shaped piece of aluminum of substantially uniform construction and cross-sectional dimension along its elongated length. The core has an elongated length of approximately 340 mm, a cylindrical radius of 38 mm, having three bores or cavities 4, 5 and 6 open from one end, and having a groove in its outer cylindrical surface which spirals circumferentially around the heater core 1. The groove is rectangular in cross section, having a depth of 11 mm and a width of 6.35 mm. The wall thickness between successive adjacent portions of the groove is 4.94 mm. Because of the dimensions and material of the core 1, it has a substantial thermal mass.

The core 1 is threadedly attached to the control box 16 at the upper (in the FIGURE) or outlet end of the heater core 1.

A cylindrical, plated steel cover 2 having an inside diameter of 0.08 to 0.20 mm greater than the outside diameter of the heater core 1 girds the core 1 for at least the whole extent of the spiraled groove. The groove on the heater core 1 combines with the cover 2 to form a spiraled passage 3, the surface of which is in heat exchange relationship with fluid in the passage 3. Because the cover 2 is larger in diameter than the core 1, there is a gap 15 between the cover 2 and core 1. The gap 15 between the inside of the cover 2 and the outside of the heater core 1 is maintained under 0.20 mm so that the fluid to be heated spirals around the core 1 rather than passing directly across the gap 15. The cover 2 is sealed to the core 1 by means of O-rings 12, 13 beyond each end of the spiraled passage 3. The cover 2 is held in place by a steel retaining ring 14 at the lower end, and a hose connection fitting 20 at the upper end. An inlet fluid passage 18 and an outlet fluid passage 19 both located interiorly of the heater core 1 each communicate one end of the spiraled passage 3 to the exterior of the core 1. These inlet and outlet passges 18, 19 are each adapted to terminate in a suitable hose connection fitting.

The three cavities 4, 5, 6 in the heater core 1 are cylindrical, having their cylindrical axes parallel to the cylindrical axis of the heater core 1 itself. Each of the cavities 4, 5, 6 is open to the exterior of the heater core 1 through the end of the core 1 closest to the fluid discharge passage 19. One of the cavities, the heating element cavity 4, is located centrally of the heater core 1 and houses a cylindrically shaped heating element 7. This central cavity 4 has a cylindrical diameter of 12.7 mm and extends into the core 1 such that the bottom or lower extremity of the cavity 4 is radially opposite the most upstream part of the spiraled passage 3. The remaining two cavities 5, 6 are located radially between the central cavity 4 and the outer surface of the heater core 1. A sensor cavity 5, houses a temperature sensor element 10, and the remaining cavity 6 houses a heat limiter 9 which is optional.

Power lines 21 to the heating element 7, and the control lines 22 from the temperature sensor 10 enter a chamber in the control box 16 and are connected to a control mechanism (not shown).

The heating element 7 is a cartridge type heating element and can be one sold under the Trademark "Firerod" manufactured by Watlow Electric Manufacturing Company. It is located in the central cavity 4 and is shorter than the elongated length of the part of the heater core 1 having the spiraled groove. The heating element 7 has a close tolerance fit to the central cavity 4 so that heat will pass readily from the heater element 7 radially into the portion of the heater core 1 radially adjacent to the heating element 7. The heater core in turn heats the fluid in the passage.

When the heater core 1 is threaded onto the control box 16 a hollow aluminum tube 23 through which the power lines 21 to the heater element 7 pass, is urged by a control mechanism housing 8 in the control box 16 against the end of the heating element 7 so as to hold the heating element 7 into the bottom or lower part of the central cavity 4. The tube 23 has annular dimensions such that its end will abut against the top of the heating element 7 and such that the power lines 21 to the heater element 7 can pass through its hollow center portion. Thus, the heating element 7 is positioned so as to be radially opposite to and effectively directly heat only the upstream portion (or in the figure, the bottom portion) of the spiraled fluid passage 3. The spiraled passage 3 continues downstream beyond the location where the heating element 7 is radially proximate the spiraled passage 3. In this embodiment the heating element 7 is proximate the spiraled passage 3 for approximately 165 mm, and the spiraled passage 3 continues for approximately another 41 mm of heater core length. This downstream 1/5 of the fluid passage 3 is substantially unheated by direct radial action of the heating element 7.

The temperature sensor 10 is located in the sensor cavity 5 radially between the heater cavity 4 and the cylindrical outer surface of the heater core 1. This sensor can be a type sold as a Model 102 by Essex International Co., Controls Division. The sensor 10 is a low pressure averaging type sensor, of elongated cylindrical configuration. It has a 4° on/off differential. That is, it is effective to turn the heater element 7 on at 4° F. lower than it is to turn the heating element 7 off. The sensor 10 senses temperature along substantially its full length, and its output is related to the average of the temperatures sensed.

The temperature sensor 10 actually responds to the temperature of the heater core 1. However, this temperature to which the sensor responds is primarily influenced by or associated with the temperature of the fluid in the part of the passage 3 radially proximate the sensor 10. Because the sensor 10 is a low pressure type and the fluid is under a higher pressure than the sensor 10 can withstand it is not positioned to sense the actual temperature of the fluid in the spiraled fluid passage 3. However, the cavity 5 for the sensor 10 is positioned such that the sensor 10 will be as close as possible to the spiraled fluid passage 3, while still leaving enough wall thickness between the spiraled passage 3 and the sensor cavity 5 to safely withstand the pressures to which the fluid may be subjected. This wall thickness may vary depending on the fluid pressures and the heater core material.

The averaging center 11 of the temperature sensor 10 is located radially opposite the most downstream point 24 of the heating element 7 (the top of the heating element 7 in the figure). This location generally corresponds to the point along the spiraled fluid passage 3 which will experience the greatest temperature cycling excursion, overshoot and undershoot. Sensing the temperature at this location provides optimum feedback control.

An averaging type sensor 10 is used for the sake of economy. A point sensor, which responds to the temperature at a specific location or point, could be used. If a point sensor were used, the sensor cavity 5 need only extend into the heater core 1 to a point radially adjacent to the top of the heating element 7, and the sensor would monitor the temperature of the core 1 at the bottom of this shortened cavity 5.

The output of the temperature sensor 10 is operatively connected to a control mechanism 8 which responds to the sensor output so as to energize and de-energize the heating element 7 to maintain the desired fluid temperature.

Because temperature control mechanisms are relatively well known in the art, the control mechanism need not be discussed in detail here. In general, the control mechanism responds to the temperature sensor 10 so as to energize the heating element 7 when the temperature sensed by the sensor 10 is below some desired preset value, and to de-energize the heating element 7 when the temperature sensed is greater than a desired preset value.

It is to be noted that the amount of damping to the steady-state peak-to-peak cycling, overshoot and undershoot of temperature is not the same at all flow rates. The damping is more pronounced at the higher flow rates. Additionally, it is to be noted that the steady-state peak-to-peak cycling, overshoot and undershoot are not necessarily damped by the same respective amounts.

Having described my invention, I claim:

1. A heater for liquid moving in a conduit comprising:

a heater body having an elongated liquid passage said liquid passage having an inlet, an upstream portion, a downstream portion and an outlet in series flow relationship;

a heating element associated with said heater body and effective to directly heat liquid in substantially only the upstream portion of the passage;

temperature responsive control means for controlling operation of the heating element, said means being responsive to a pre-selected temperature primarily associated with the temperature of the liquid at the most downstream part of said directly heated upstream portion of the liquid passage proximate the point in the passage where the liquid exhibits its greatest temperature variation under constant flow rate conditions;

said downstream portion of said passage being substantial in size and being in indirect heat conductive heat exchange relationship with said directly heated upstream portion, said downstream portion being an integral part of the heater body, being in heat exchange relationship with the liquid passing through it, and having a thermal mass in conductive heat exchange relationship with said downstream portion of sufficient size to damp temperature cycling variations of overshoot and undershoot at the outlet of the passage.

2. The apparatus of claim 1 wherein the unheated portion of the passage is a continuation of the heated passage in a common assembly, but wherein the heating element is proximate the fluid passage at only its upstream portion.

3. A heater for pressurized liquid moving in a conduit comprising:

a thermally massive heater body having two separate cavities;

a heating element in one of the cavities effective to directly heat only a portion of the body the remaining portion of said body being thermally massive and being in conductive heat exchange relationship with said directly heated portion;

an elongated liquid passage in the body having an inlet and outlet, and being in heat exchange relationship with the liquid in the passage and with the body, the upstream part of said passage being located in the directly heated portion of the body so as to be in immediate thermal proximity to the heating element, but said passage further continuing downstream within said remaining thermally massive portion of the heater body for a substantial distance beyond the portion of the body directly heated by the heating element;

a temperature responsive sensor in the other cavity of the heater body, in proximity to the liquid passage but in non-contacting relationship therewith, and located to respond primarily to the temperature of the portion of the body proximate the point in the passage where the liquid exhibits its greatest temperature cycling variation under constant flow rate conditions, said thermally massive portion being of such size as to damp temperature cycling variations of overshoot and undershoot of the liquid at the outlet of said heater; and a control means for controlling operation of the heating element, responsive to the sensor.

4. A heater for liquid moving in a conduit comprising:

a generally cylindrical elongated heater core having a central cavity;

cover means around the heater core and means on at least one of said cover and core forming a spiraled liquid passage between the core and the cover wherein liquid in the passage is in heat exchange relationship with the core;

inlet means at one end of the passage and outlet means at the other end of the passage;

a heating element means in the central cavity effective to directly apply heat radially to only a first portion of the heater core immediately proximate an upstream portion of the passage while leaving a significant second portion of the heater core proximate a substantial downstream portion of the passage having substantially no heat directly applied to it radially from the heating element means, but said second portion of the heater core being in heat exchange relationship with said first portion and defining a substantial thermal mass of such size as to damp temperature cycling variations of overshoot and undershoot of the liquid at the outlet of the heater; and control means for controlling operation of the heating element means including a temperature responsive sensor means arranged to sense a temperature primarily associated with the temperature of the liquid in the most downstream part of the passage that is radially proximate the directly heated portion of the core.

5. The apparatus of claim 4 wherein said spiraled passage is formed in part by a spiraled groove on the cylindrical surface of said heater core.

6. The heater of claim 4 wherein the heating element means comprises an elongated heater radially adjacent the upstream portion of the passage, with a first end closer to the downstream portion of the passage and a second end closer to the upstream portion of the passage;

and wherein the heater core further comprises a second cavity elongated in the direction of the cylindrical axis of the core, and located radially between the heating element means and the liquid passage;

and wherein the temperature sensor comprises an elongated averaging type sensor in said second cavity having its averaging center located opposite said first end of the heating element means.

7. The heater of claim 6 wherein said spiraled passage is formed in part by a spiraled groove on the cylindrical surface of said heater core.

8. The heater of claim 4 wherein:

the core and cover are of substantially uniform construction and cross sectional dimensions along their elongated lengths; and the heating element means comprises an elongated heating element radially opposite no more than the upstream four-fifths of the spiraled passage.

9. The heater of claim 8 wherein:

the heater core further comprises a second cavity elongated in the general direction of the cylindrical axis of the core and located radially between the heating element means and the liquid passage;

said heating element means has an end closer to the downstream portion of the liquid passage; and the temperature sensor comprises an elongated averaging type sensor in said second cavity having its averaging center located radially opposite said end of the heating element means closer to the downstream portion of the fluid passage.

10. The heater of claim 9 wherein said spiraled passage is formed in part by a spiraled groove on the cylindrical surface of said heater core.

11. In an in-line heater for liquid moving in a conduit comprising: an elongated heater body with a liquid passage therein; heater means for directly heating liquid in substantially only an upstream portion of the passage; a sensor responsive to a temperature associated with the temperature of the heated liquid at the most downstream part of the directly heated upstream portion of the liquid passage at the point where the liquid exhibits its greatest temperature cycling variations under constant flow conditions; and a control mechanism operatively connected to said heater means and responsive to said sensor, the improvement which comprises:

said heater body including an integral thermal accumulator of substantial thermal mass of such size as to damp temperature cycling variations of overshoot and undershoot of the liquid at the outlet of the heater and located downstream of the directly heated portion of said passage in heat exchange relation with a substantial downstream portion of the passage.

* * * * *